US005244380A

United States Patent [19]

Döbbeling et al.

[11] Patent Number: 5,244,380

[45] Date of Patent: Sep. 14, 1993

[54] BURNER FOR PREMIXING COMBUSTION OF A LIQUID AND/OR GASEOUS FUEL

[75] Inventors: Klaus Döbbeling, Nussbaumen; Thomas Sattelmayer, Mandach, both of Switzerland

[73] Assignee: Asea Brown Boveri Ltd., Baden, Switzerland

[21] Appl. No.: 844,169

[22] Filed: Mar. 2, 1992

[30] Foreign Application Priority Data

Mar. 12, 1991 [CH] Switzerland ..... 00734/91

[51] Int. Cl.[5] ..... F23C 5/00

[52] U.S. Cl. ..... 431/8; 431/173; 431/284; 431/354

[58] Field of Search ..... 431/2, 8, 173, 10, 116, 431/284, 354, 182, 285, 350; 60/737, 748; 239/290, 399, 403; 110/264, 347

[56] References Cited

U.S. PATENT DOCUMENTS 3,834,854 9/1974 Vanderveen ..... 431/173
4,932,861 6/1990 Keller et al. ..... 431/173
5,085,575 2/1992 Keller et al. ..... 431/173

FOREIGN PATENT DOCUMENTS 0321809 6/1989 European Pat. Off. .
2051676 5/1972 Fed. Rep. of Germany .

*Primary Examiner*—James C. Yeung
*Attorney, Agent, or Firm*—Burns, Doane, Swecker & Mathis

[57] ABSTRACT

In a burner for premixing-type combustion of a liquid and/or gaseous fuel, which essentially comprises hollow conical part-bodies (1, 2) positioned one upon the other, the center lines of which extend mutually offset in the longitudinal direction, whereupon tangential inlet openings (**1*b*, 2*b*) are formed on both sides of the burner, a fuel (5*a*) is admixed to the combustion air (13) flowing into the interior (3) of the burner in that area. This admixture is accomplished via a number of nozzles (9, 10), which act in the region of the inlet openings (1*b*, 2*b*). The fuel through these nozzles is injected with a small spray cone angle in the longitudinal direction of the slot. The fuel vaporization takes place essentially only in the inlet openings of the burner, with the result that only a fuel vapor enters the interior (3). A further central nozzle (4) supplied with a liquid and/or gaseous fuel provides assistance in the form of a limit fuel quantity. The ignition of the mixture (4*a*, 5*a*, 13) takes place at the outlet of the burner, stabilization of the flame front (14) being brought about in the region of the burner aperture by a return flow zone (15**).

13 Claims, 3 Drawing Sheets

BURNER FOR PREMIXING COMBUSTION OF A LIQUID AND/OR GASEOUS FUEL

BACKGROUND OF THE INVENTION

1. Field of the Invention

The present invention relates to a burner for premixing-type combustion of a liquid fuel. It also relates to a method for operating such a burner.

2. Discussion of Background

U.S. Pat. No. 4,932,861 to Keller has disclosed a burner, in the interior of which is placed a fuel nozzle which forms a conical fuel spray which spreads out in the direction of flow. Around the spray combustion air streams flowing in tangentially to the interior of the burner flow and which is broken down as regards the mixture in the direction of flow of the burner. The tangential inlet openings into the interior of the burner are formed by virtue of the fact that the burner itself comprises two hollow conical part-bodies, the center lines of which extend in mutually offset fashion. The ignition of this air/fuel mixture takes place at the outlet of the burner, and in the region of the burner aperture a return flow zone forms which, together with the high axial velocity upstream thereof, prevents the occurrence of a kickback of the flame from the combustion chamber in the upstream direction into the burner.

If diesel oil is used as a fuel for operating a combustion chamber, it has been found that this can ignite immediately after being admixed to the burner. For this reason, it is not always possible to achieve premixing-type operation under relatively high pressure conditions using a liquid fuel. The reason for the large deviations as regards ignition delay time is also connected with the flame radiation: under high pressure, the flame radiation will be very great; a significant portion of the radiation is absorbed by the fuel droplets (opaque mist). This mechanism of the energy transfer to the liquid fuel leads to a drastic reduction in the ignition delay time.

SUMMARY OF THE INVENTION

It is here that the invention intends to provide a remedy. It is the object of the invention as characterized in the claims to propose a low-emission, dry combustion of a liquid fuel in the case of a burner and a method of the abovementioned type, the aim being to suppress the interaction between flame radiation and fuel droplets, which leads to premature ignition of the mixture.

The essential advantage of the invention is to be seen in the fact that the liquid fuel is injected into a region directly upstream of its entry into the interior and is there admixed to the combustion air stream. Due to the fact that the fuel vaporization takes place essentially only in the inlet openings of the burner, only fuel vapor enters the interior of the burner. Thus, since the fuel enters the radiation region of the flame only after its vaporization, the risk of premature ignition of the mixture is consequently eliminated for a vaporized fuel absorbs virtually no flame radiation. Combustion with low levels of NOx/CO/UHC can thus be achieved.

Advantageous and expedient further developments of the solution, according to the invention, of the object are defined in the further, dependent claims.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
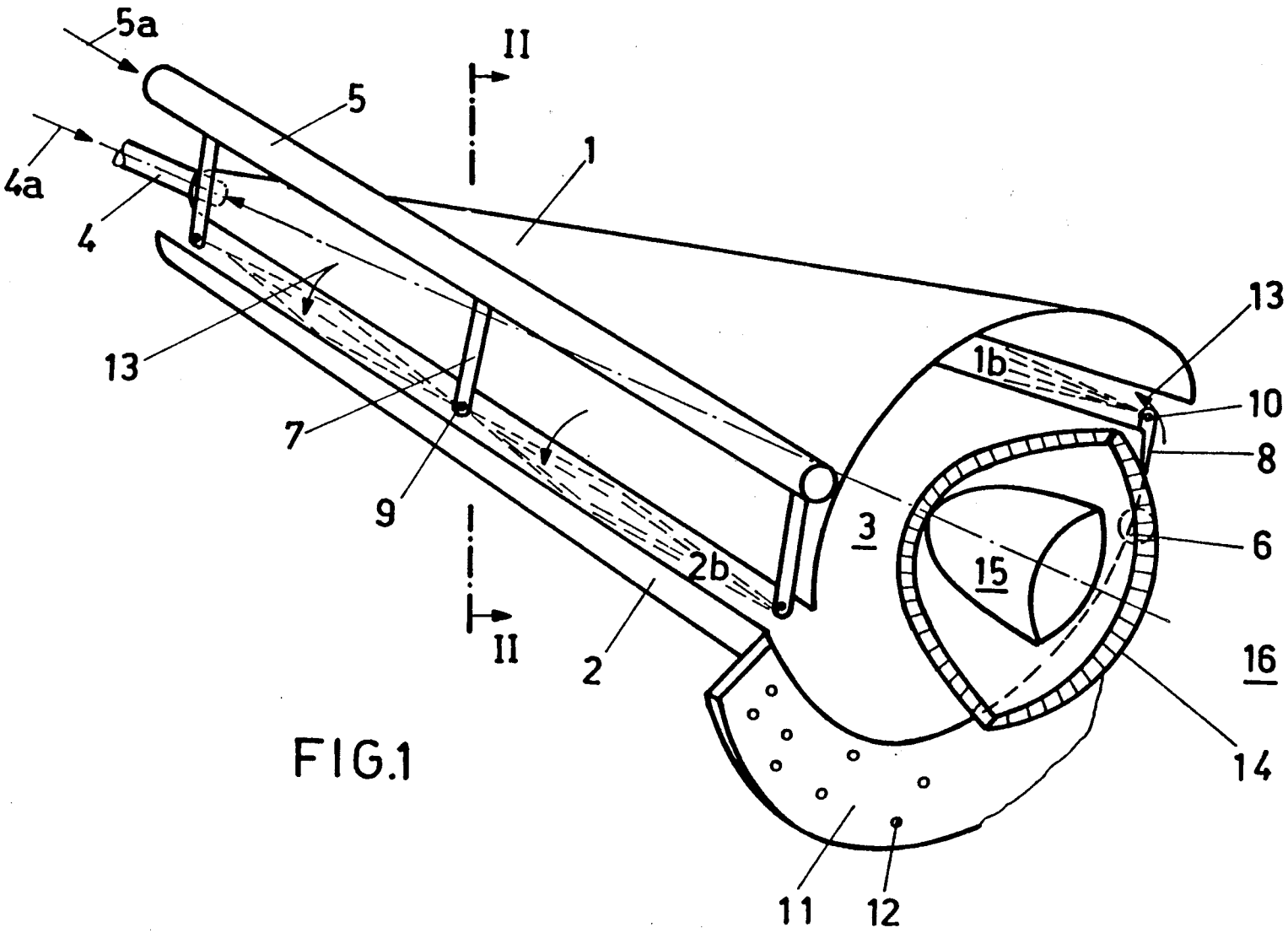
FIG. 1 is a perspective representation of a burner of a preferred embodiment of the present invention.
Figure 3:
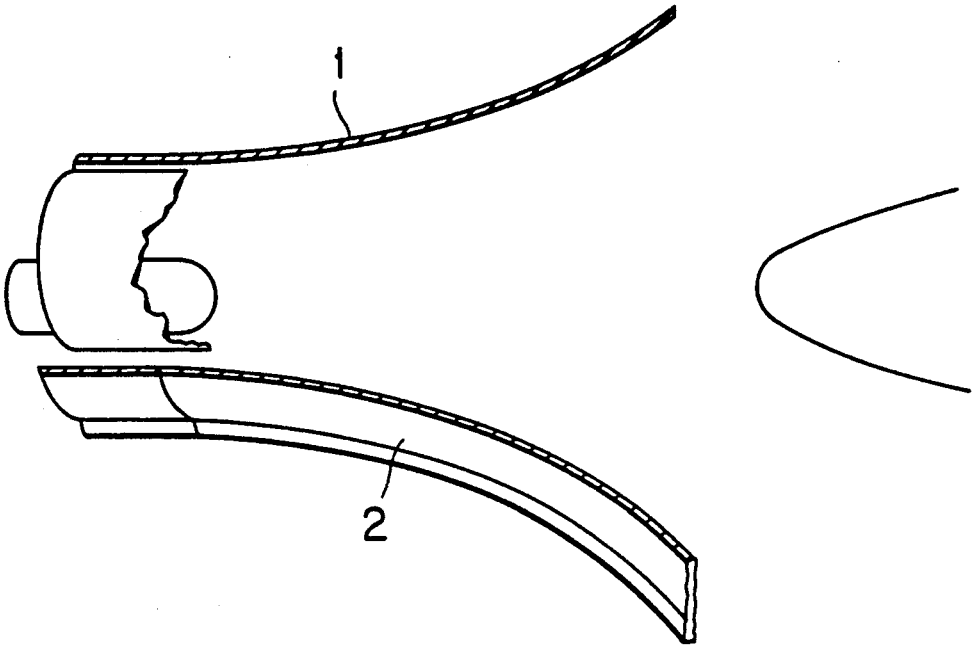
FIG. 3 is a partial sectional view of an alternative embodiment of the burner of the present invention having a progressive conical body inclination.
Figure 4:
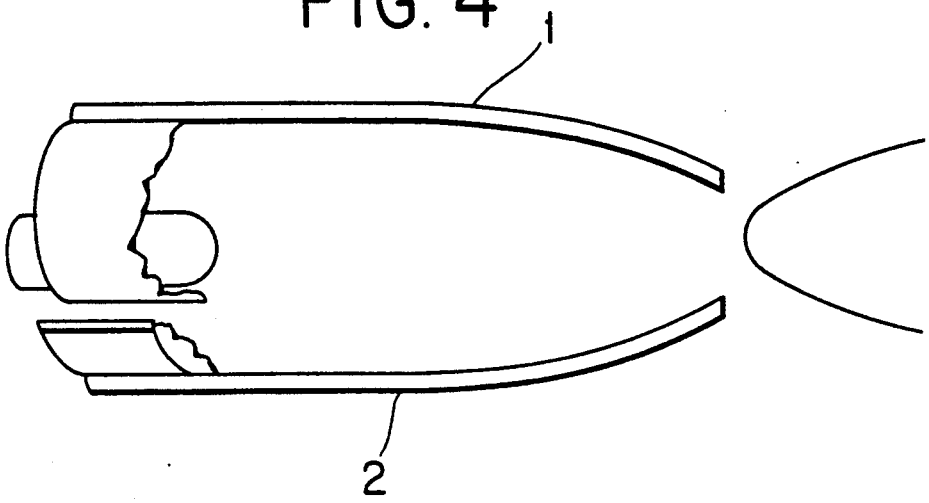
FIG. 4 is a partial sectional view of another alternative embodiment of the burner of the present invention having a degressive conical body inclination.

Referring now to the drawings, which, for a better and immediate understanding of the structure of the burner, should be taken together and wherein like reference numerals designate identical or corresponding parts throughout the two views. In addition all elements not required for the direct understanding of the invention having been omitted and the direction of flow of the media being indicated by arrows. In FIG. 1, the core body of the burner shown comprises two half, hollow, conical part-bodies 1, 2 which rest one upon the other in mutually offset fashion and thus form the body appropriate for the application. The offset of the respective center lines 1*a*, 2*a* (see FIG. 2) of the individual part-bodies 1, 2 creates a free tangential inlet opening 1*b*, 2*b* on each of the two sides of the burner in an axially symmetrical arrangement. Inflow of an air/fuel mixture into the interior 3 of the burner, i.e. into the conical cavity, takes place, the air/fuel mixture flowing into the interior 3 through the 180° offset inlet openings 1*b*, 2*b* in the clockwise or counterclockwise direction depending on the plane in which the offset of the center lines 1*a*, 2*a* lies. In FIG. 1 the conical shape of the illustrated part-bodies 1, 2 in the direction of flow has a certain fixed angle. The part-bodies 1, 2 can of course describe an increasing cone inclination (convex shape) or a decreasing cone inclination (concave shape) in the direction of flow. FIG. 3 is a partial sectional view of the burner wherein the conical part bodies have a progressive conical inclination in the direction of flow. FIG. 4 is a partial sectional view of the burner wherein the part-conical bodies have a degressive conical inclination in the direction of flow. The shape which is finally used depends on the various parameters of the combustion process. The shape shown in FIG. 1 in the drawings is the preferred embodiment. The tangential width of the inlet openings 1*b*, 2*b* is a dimension which results from the mutual offset of the two center lines 1*a*, 2*a* (see FIG. 2). The two conical part-bodies 1, 2 can each have a cylindrical initial portion (not shown), the two initial portions extending in mutually offset fashion similarly to the part-bodies shown, the tangential inlet openings 1*b*, 2*b* thus being present over the entire length of the particular burner. On the combustion-chamber side 16, the burner has a collar-shaped plate 11, which can, for example, form the inlet front of an annular combustion chamber or a combustion installation. The plate 11 has a number of holes or openings 12, through which dilution air, combustion air, cooling air etc. can be supplied to the front part of the combustion chamber 16. Basically, this supply fulfills at least two purposes: firstly, an appropriate composition can be achieved in the combustion chamber 16 and, secondly, this supply ensures a stabilization of the flame front with the aim of a compact structure. Operating along the inlet openings 1*b*, 2*b* to the interior 3 of the burner are a plurality of nozzles 9, 10. Each nozzle draws draw the liquid fuel 5*a*, via nozzle conduits 7, 8, from a central feed conduit arranged at each inlet opening 1*b*, 2*b*. The central feed conduits 5, 6 are placed upstream of the inlet openings 1*b*, 2*b* in relation to the combustion air stream 13. The task of bridging the gap between the supply line and the air/fuel mixing location along the inlet openings 1*b*, 2*b* is assumed by the nozzle conduits 7, 8 already mentioned above. The number of nozzle conduits 7, 8 depends essentially on the length and the required output of the burner. The liquid fuel is injected with a small spray cone angle via the nozzles 9, 10 in the longitudinal direction of the inlet openings 1*b*, 2*b*. Account should of course be taken of the fact that the nozzles at the ends of the burner must face one another, i.e. the first nozzle at the burner inlet must face in the direction of flow, while the last nozzle at the burner aperture must face in the counterflow direction. Located between the ends of the inlet openings is a pair of nozzles 9 which are directed to spray fuel towards the ends of the inlet, that is, in mutually opposing directions. This distinction is underlined by the different reference numerals: the nozzles acting in both directions bear the reference numeral 9, while the nozzles acting at the ends of the burner bear the reference numeral 10. The nozzles can also be inclined slightly to the burner axis in order to increase the degree of mixing. As regards their construction, the nozzles can employ simple technology: thus, it is quite possible for them to be simple orifice nozzles such as those encountered, for example, in diesel engine technology. For optimum atomization of a liquid fuel, a high-pressure atomizing nozzle with a turbulence chamber is preferably provided. In this way, part of the available nozzle admission pressure is used to produce high degrees of turbulence in the fluid to be atomized. The production of turbulence is here achieved by means of an abrupt widening (Carnot diffuser) into the turbulence chamber arranged upstream of the actual nozzle orifice. The liquid-fuel spray produced is distinguished by small angles of spread, corresponding to the relatively small width of the inlet openings, and very small droplet sizes. The fuel vaporization occurs essentially only in the region of the inlet openings 1*b*, 2*b* into the interior 3 of the burner, with the result that only a fuel vapor enters there. To ensure that the small fuel droplets necessary for this purpose, having a mean diameter of approximately 20 micrometers, can be produced, very high pressures, of the order of above 100 bar, must be applied to the liquid fuel. It is furthermore important that the nozzles be arranged in such a way that a uniform fuel vapor distribution along the inlet openings 1*b*, 2*b* is established and that the surface of the adjacent walls is not wetted, in the latter case in order to avoid risks of coke deposition during combustion. It is, of course also possible to provide operation with a gaseous fuel, in which case the quality of fuel vaporization can be readily achieved. An additional central fuel nozzle 4, supplied with a liquid and/or gaseous fuel 4*a*, is provided at the start of the burner. The additional nozzle is intended, in the case of a specific requirement, to run the combustion process with diffusion-type combustion, using a limit fuel quantity required in the case of low thermal outputs and low fuel momentum; this fuel supply is then completely, or at least largely, suppressed, depending on the type of fuel. This assistance will vary within a tolerance range which does not render impossible the aims specific to the object of the subject-matter of the invention. It is thus readily possible, within the existing range of nozzles. to operate in a dual mode as regards the fuel. In accordance with the geometric design of the burner, the air/fuel mixture 13/5*a* flowing into the interior 3 through the tangential inlet openings 1*b*, 2*b* forms a conical mixture profile which twists vortex-wise in the direction of flow. In the region of vortex breakdown, that is to say at the end of the burner, where a return flow zone 15 forms, the optimum, homogeneous fuel concentration over the cross-section is achieved, i.e. here, in the region of the return flow zone 15, the fuel/air mixture is very homogeneous. Ignition itself takes place at the tip of the return flow zone 15: only at this point can a stable flame front 14 arise. There is no risk here of a kickback of the flame into the interior of the burner, which is a constant risk in the case of known premixing sections, where complicated flame retention baffles are used in an attempt to remedy the problem. Narrow limits are to be observed in the configuration of the part-bodies 1, 2 as regards their conical design and as regards the width of the inlet openings 1*b*, 2*b* in order to ensure that the desired flow field of the combustion mixture used, with its return flow zone 15, can be established in the region of the burner aperture for the purpose of flame stabilization. Since the injection of the fuel is now performed in the region of the inlet opening 1*b*, 2*b* and fuel vaporization takes place there immediately, the flame radiation produced by the flame front 14 does not exert any effect on the mixture 5*a*/13 and, accordingly, the risk of premature ignition of this mixture upon its entry into the interior 3 of the burner is eliminated. Another point which must be mentioned is that it is precisely this fuel vaporization before entry into the combustion zone which is responsible for the very low pollutant emission values.

Figure 2:
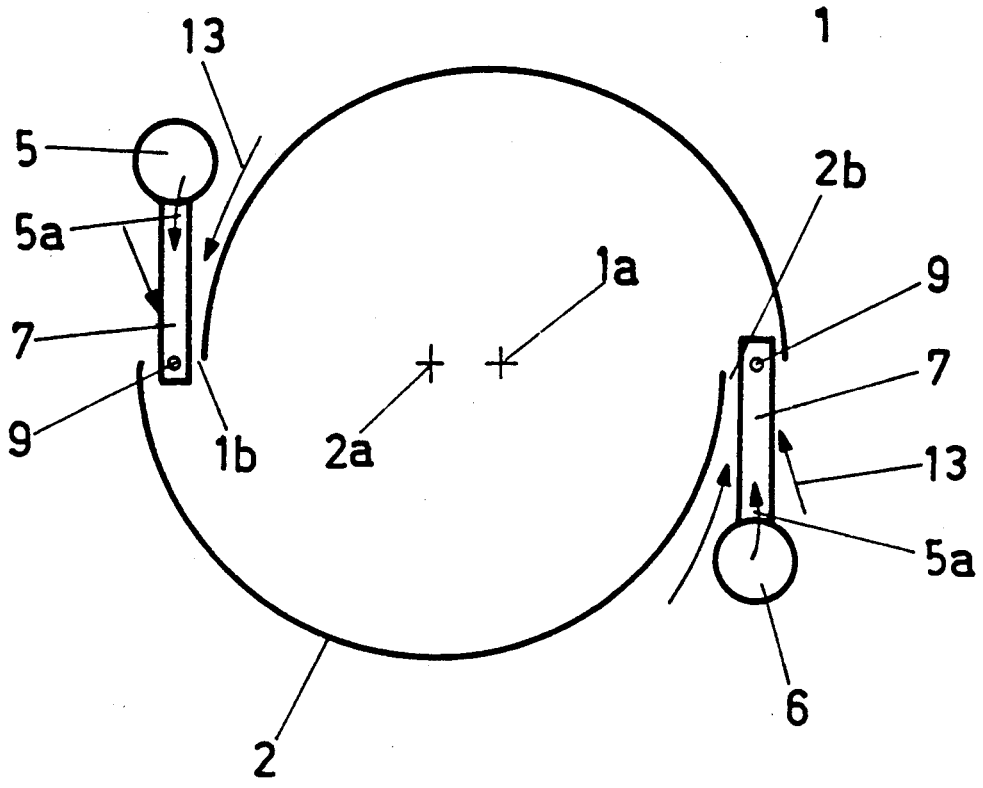
FIG. 2 is a schematic representation of air supply and fuel injection in the region of the inlet openings of the burner.

FIG. 2 is a section through the burner along a plane in the region of the central nozzle conduit 7. The combustion air 13 as a function of the fuel must be matched in such a way that the degree of fuel vaporization taken as a basis can be achieved exclusively in the region of the inlet openings 1*b*, 2*b*. With this in mind, it is advantageous if the combustion air 12 is an air/exhaust gas mixture: the recirculation of a certain quantity of a partially cooled exhaust gas proves advantageous not only when using the burner in gas turbine groups but also when the burner is used in atmospheric combustion installations in the case of a near-stoichiometric mode of operation, i.e. when the ratio of recirculated exhaust gas to fresh air supplied is about 0.7. At a fresh-air temperature of, for example, 15° C. and an exhaust gas temperature of about 950° C., a mixing temperature of the air/exhaust gas mixture, now fed in instead of a pure stream of fresh air, of about 400° C. will be established. In the case, for example, of a burner which is operated with a liquid fuel and has a thermal output of between 100 and 200 KW, these relationships lead to optimum vaporization conditions and, accordingly, to a minimization of the NOx/CO/UHC emissions in the subsequent combustion process.

In conclusion, one may add that the subject-matter of the invention described here renders any injection of water into the combustion zone unnecessary. It is also the case that there is no need to provide an atomizing compressor as a remedy against insufficient fuel vaporization. Both when a liquid and a gaseous fuel are used, only fuel vapor emerges from the inlet openings into the interior 3 of the burner, approximately similar concentration profiles being recorded for both types of fuel.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A burner for premixed combustion of one of a liquid and gaseous fuel, comprising:

two hollow conical part-bodies, each body having a longitudinal centerline;

the hollow conical part-bodies positioned adjacent one another, the respective center lines parallel and mutually offset so to form a burner body having a substantially conical interior space, a start and an outlet end, and two longitudinally extending inlet openings for tangential inflow of a combustion air stream into the interior of the burner; and, at least one nozzle arranged in the region of each inlet opening for injecting a fuel in the longitudinal direction of the inlet openings, essentially transversely to a tangentially inflowing combustion air stream into the interior of the burner.

2. The burner as claimed in claim 1, further comprising a plurality of nozzles arranged in the region of each inlet opening, wherein nozzles placed at each end of the inlet openings are each directed to inject towards the other end of the inlet opening, and at least one pair of nozzles placed between the ends of the inlet openings are directed to inject in mutually opposing directions toward the ends of the inlet openings.

3. The burner as claimed in claim 1, wherein the spray direction of the nozzles is inclined toward the longitudinal axis of the burner.

4. The burner as claimed in claim 1, wherein the nozzles are connected for fuel flow to central feed conduits, which extend along the burner body upstream of the inlet openings.

5. The burner as claimed in claim 1, wherein, in the direction of flow, the conical inclination of the part-bodies is at a fixed angle.

6. The burner as claimed in claim 1, further comprising a further nozzle placed in the burner interior at the start of the burner for injection of one of a liquid and gaseous fuel into the interior of the burner.

7. The burner as claimed in claim 1, wherein the part-bodies include a collar-shaped plate at the outlet end substantially perpendicular to the axis of the conical part-body, said plate having a number of openings.

8. The burner as claimed in claim 1, wherein the part-bodies have a progressive cone inclination in the direction of flow.

9. The burner as claimed in claim 1, wherein the part-bodies have a degressive cone inclination in the direction of flow.

10. A method for operating a burner of the type comprising:

two hollow conical part-bodies, each body having a longitudinal centerline;

the hollow conical part-bodies positioned adjacent one another, the respective center lines parallel and mutually offset so to form a burner body having a substantially conical interior space, a start and an outlet end, and two longitudinally extending inlet openings for tangential inflow of a combustion air stream into the interior of the burner;

at least one nozzle arranged in the region of each inlet opening for injecting a fuel in the longitudinal direction of the inlet openings, essentially transversely to the tangentially inflowing combustion air stream, into the interior of the burner; and, a further nozzle in the interior of the burner at the start, the method comprising:

injecting a fuel with a small spray cone angle in the longitudinal direction of the inlet opening;

allowing an inflowing combustion air stream through the inlets openings to vaporize the fuel essentially only in the inlet openings, wherein only a fuel vapor flows into the interior of the burner;

injecting, through the further nozzle at the start of the burner, one of a liquid and gaseous fuel up to a limit fuel quantity; and, igniting the mixture, wherein ignition takes place at the outlet of the burner, a stabilization of a flame front being brought about in the region of the burner outlet by a return flow zone.

11. A burner for premixed combustion of a fuel, comprising:

two hollow, conical part-bodies, each body having a longitudinal centerline;

the hollow conical part-bodies positioned adjacent one another, their respective center lines parallel and mutually offset so to form a burner body having a substantially conical, hollow interior space, and two longitudinally extending inlet openings for tangential inflow of a combustion air stream into the interior of the burner; and, at least one nozzle for injecting a fuel arranged in each inlet opening, the nozzles being positioned to inject fuel into the inlet openings in the longitudinal direction of the inlet openings and essentially transversely to a tangentially inflowing combustion air stream, so that fuel injected into the inlet openings is vaporized by the inflowing air stream and a resulting air/fuel mixture flows into the burner body.

12. The burner as claimed in claim 11, wherein nozzles are provided at each end of the inlet openings and are each directed to inject towards the other end of the inlet opening, and at least one pair of nozzles is placed between the ends of the inlet openings and directed to inject in mutually opposing directions toward the ends of the inlet openings.

13. The burner as claimed in claim 11, wherein the nozzles are directed to inject oblique to the inlet openings and toward the interior of the burner.

* * * * *